US009676529B2

(12) United States Patent
Cavalier

(10) Patent No.: US 9,676,529 B2
(45) Date of Patent: Jun. 13, 2017

(54) ADJUSTABLE DISPENSING CAP

(71) Applicant: Ambrose P. Cavalier, Saylorsburg, PA (US)

(72) Inventor: Ambrose P. Cavalier, Saylorsburg, PA (US)

( * ) Notice: Subject to any disclaimer, the term of this patent is extended or adjusted under 35 U.S.C. 154(b) by 0 days.

(21) Appl. No.: 15/160,536

(22) Filed: May 20, 2016

(65) Prior Publication Data

US 2016/0264318 A1 Sep. 15, 2016

Related U.S. Application Data

(63) Continuation of application No. 14/029,170, filed on Sep. 17, 2013, now Pat. No. 9,371,164.

(60) Provisional application No. 61/744,098, filed on Sep. 18, 2012.

(51) Int. Cl.
*B65D 47/26* (2006.01)

(52) U.S. Cl.
CPC ..... *B65D 47/265* (2013.01)

(58) Field of Classification Search
CPC ..... B65D 47/265
USPC ..... 222/481, 480, 483, 485, 568; 215/310
See application file for complete search history.

(56) References Cited

U.S. PATENT DOCUMENTS

2006/0278665 A1* 12/2006 Bennett ..... A45D 33/16 222/480
2007/0145082 A1* 6/2007 Parve ..... B65D 47/0857 222/480
2008/0087690 A1* 4/2008 Parve ..... B65D 47/0847 222/485
2009/0159554 A1* 6/2009 McCardell ..... B29C 45/16 215/310

* cited by examiner

*Primary Examiner* — Donnell Long
(74) *Attorney, Agent, or Firm* — Design IP

(57) ABSTRACT

Embodiments of the present invention provide dispensing caps, containers, and methods for quickly and easily dispensing liquids of varying viscosities at different flow rates. In one embodiment, an adjustable dispensing cap is provided that permits a user to rotate a first member to select an appropriately sized pour hole and achieve a desired flow rate for the particular liquid to be dispensed.

20 Claims, 13 Drawing Sheets

ADJUSTABLE DISPENSING CAP

CROSS-REFERENCE TO RELATED APPLICATIONS

This application is a continuation of U.S. application Ser. No. 14/029,170, filed on Sep. 17, 2013, which claims the benefit of U.S. Provisional Application No. 61/744,098, filed Sep. 18, 2012, all of which are hereby incorporated by reference as if fully set forth.

BACKGROUND OF THE INVENTION

A dispensing cap enables a user to dispense contents of a container without having to remove the cap from the container. Typically, a dispensing cap is designed to dispense a specific liquid having a specific viscosity and will therefore include a pour hole that is sized to allow the liquid to flow at a desired flow rate. For example, dispensing caps designed to dispense foodstuffs or commercial products having a high viscosity (e.g., honey, thick lubricants, or thick adhesives) typically have a larger pour hole than those of dispensing caps designed to dispense less viscous products (e.g., vinegar or thin lubricants or adhesives).

When using a dispensing cap to dispense a liquid having a viscosity for which the cap was not designed (e.g., when reusing a container to dispense a different liquid, or when dispensing a liquid that has become thicker or thinner because of temperature or age), and/or when a user otherwise desires a faster or slower pour, the user must typically compensate to increase or decrease the flow rate of liquid dispensed from the container. For example, when dispensing liquid from a flexible plastic bottle, the user may need to squeeze the bottle with varying amounts of force. However, some users may have difficulty providing the force necessary to dispense a highly viscous liquid (e.g., elderly people or children who do not have sufficient hand strength), and dispensing liquids with a particularly high or low viscosity may simply be beyond the control of any user. Also, some containers, such as rigid bottles, might not be able to be squeezed or manipulated to achieve the desired flow rate.

There is a need in the art for inexpensive, adjustable dispensing caps that provide users with the ability to easily dispense liquids of varying viscosities as well as consistently and predictably achieve one or more desired flow rates.

SUMMARY OF THE INVENTION

Embodiments of the present invention satisfy the need in the art by providing adjustable dispensing caps that enable a user to quickly and easily dispense liquids of varying viscosities. Embodiments of the present invention incorporate a member having pour holes of various sizes. In operation, a user can rotate a member to select an appropriately sized pour hole and achieve a desired flow rate for the liquid to be dispensed. Accordingly, embodiments of the present invention provide an easy-to-use, cost-effective, and versatile way to dispense liquids having varying viscosities and/or to otherwise control the flow rate of liquid to be dispensed.

In one embodiment, a dispensing cap for a container is provided, where the dispensing cap comprises: a first member having a plurality of through holes; and a second member rotatively coupled to the first member, the second member having a plurality of through holes, wherein each through hole of the first member is disposed such that it can overlap, in whole or in part, each through hole of the second pair member depending on the rotation of one or both of the first member and second member about a longitudinal axis passing through the first member and second member.

BRIEF DESCRIPTION OF THE DRAWINGS

The present invention will hereinafter be described in conjunction with the appended drawing figures wherein like numerals denote like elements.

DETAILED DESCRIPTION OF THE PREFERRED EMBODIMENT(S)

Figure 1:
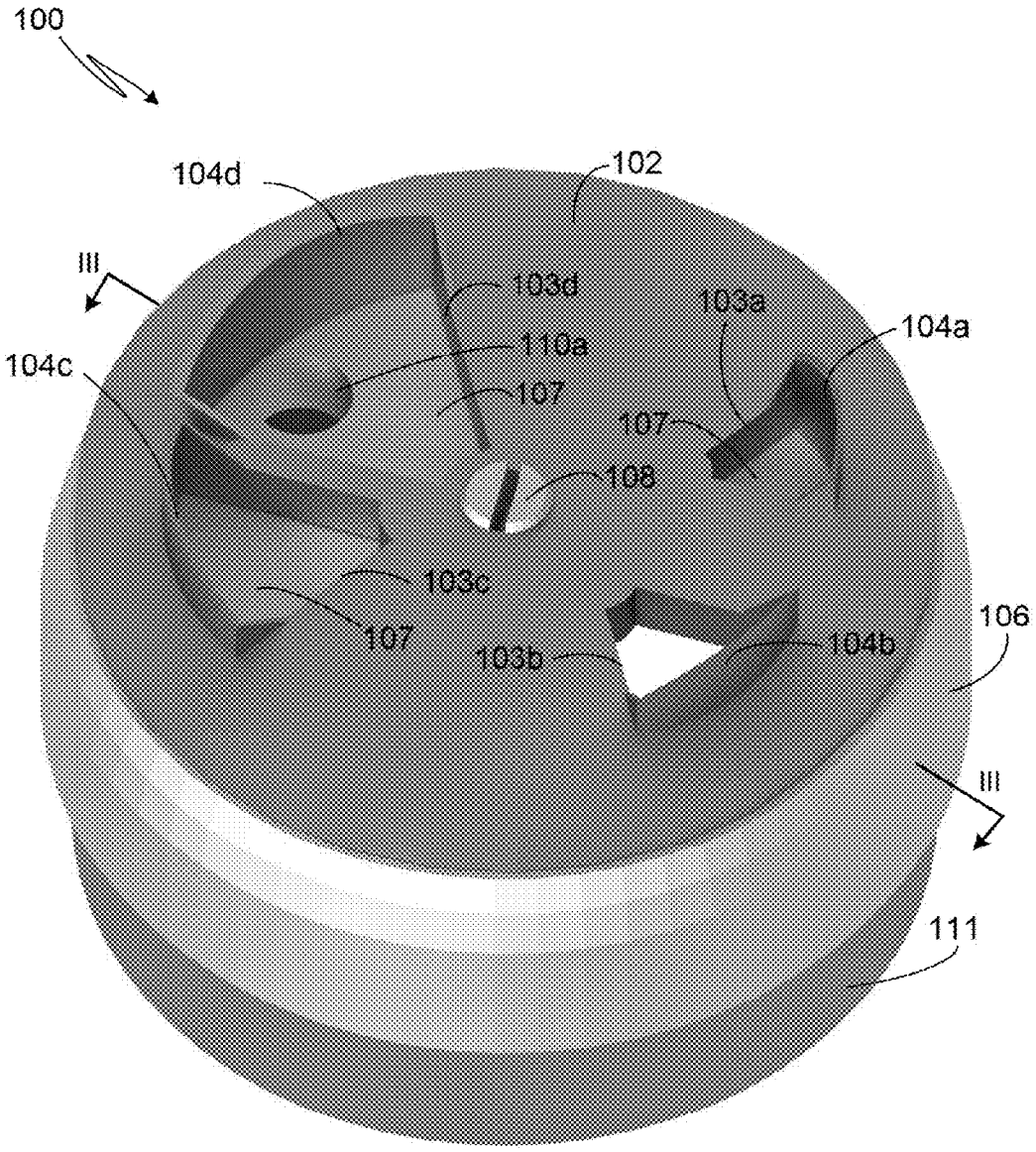
FIG. 1 is a perspective view of an assembled adjustable dispensing cap in accordance with a first embodiment of the present invention.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. Various changes may be made in the function and arrangement of elements without departing from the spirit and scope of the invention, as set forth in the appended claims.

In the figures, elements that are similar to those of other embodiments of the present invention are represented by reference numerals increased by a value of 100. Such elements should be regarded as having the same function and features unless otherwise stated or depicted herein, and the discussion of such elements may therefore not be repeated for multiple embodiments.

Figure 2:
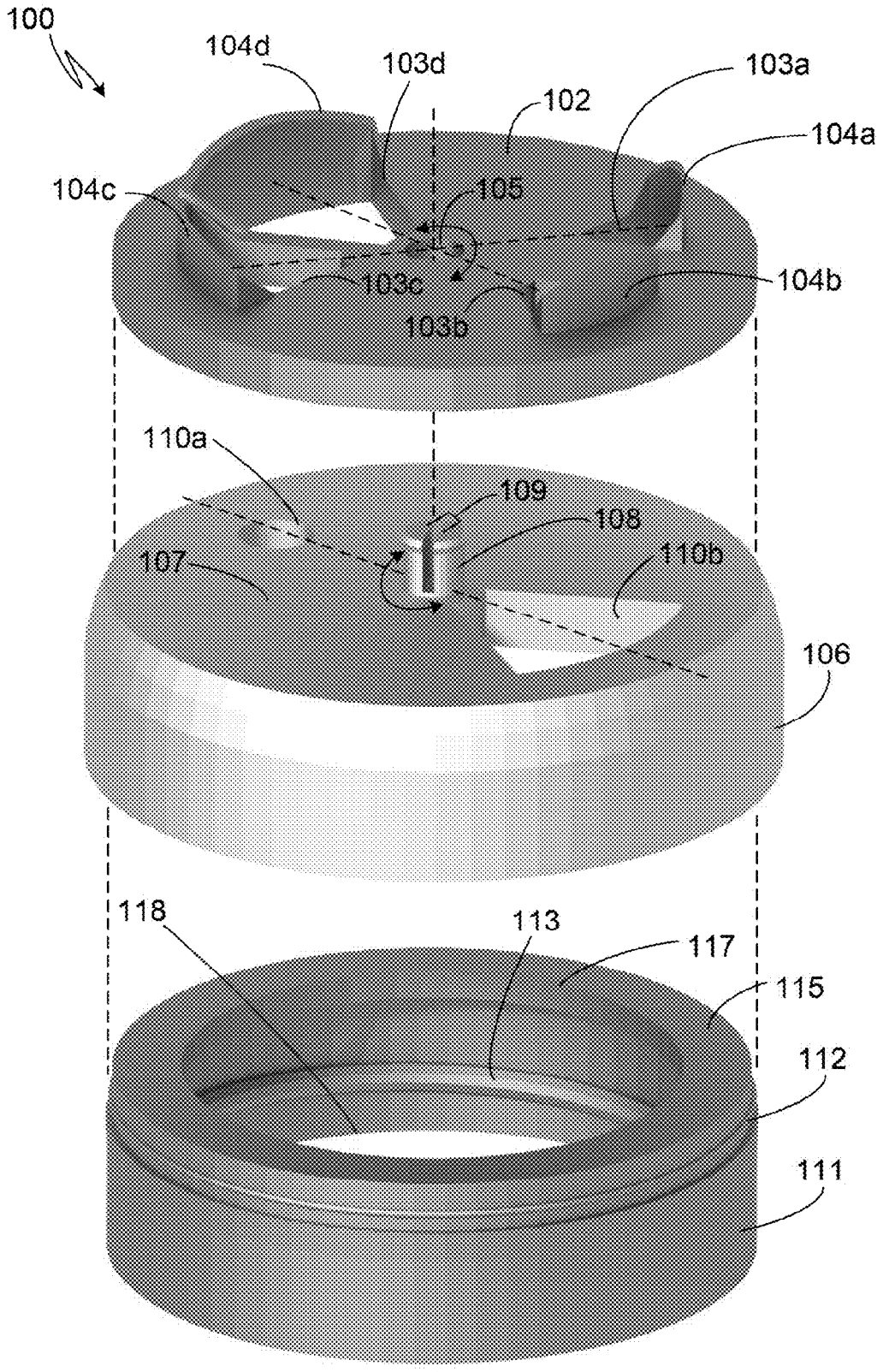
FIG. 2 is an exploded perspective view of the adjustable dispensing cap of FIG. 1.
Figure 3:
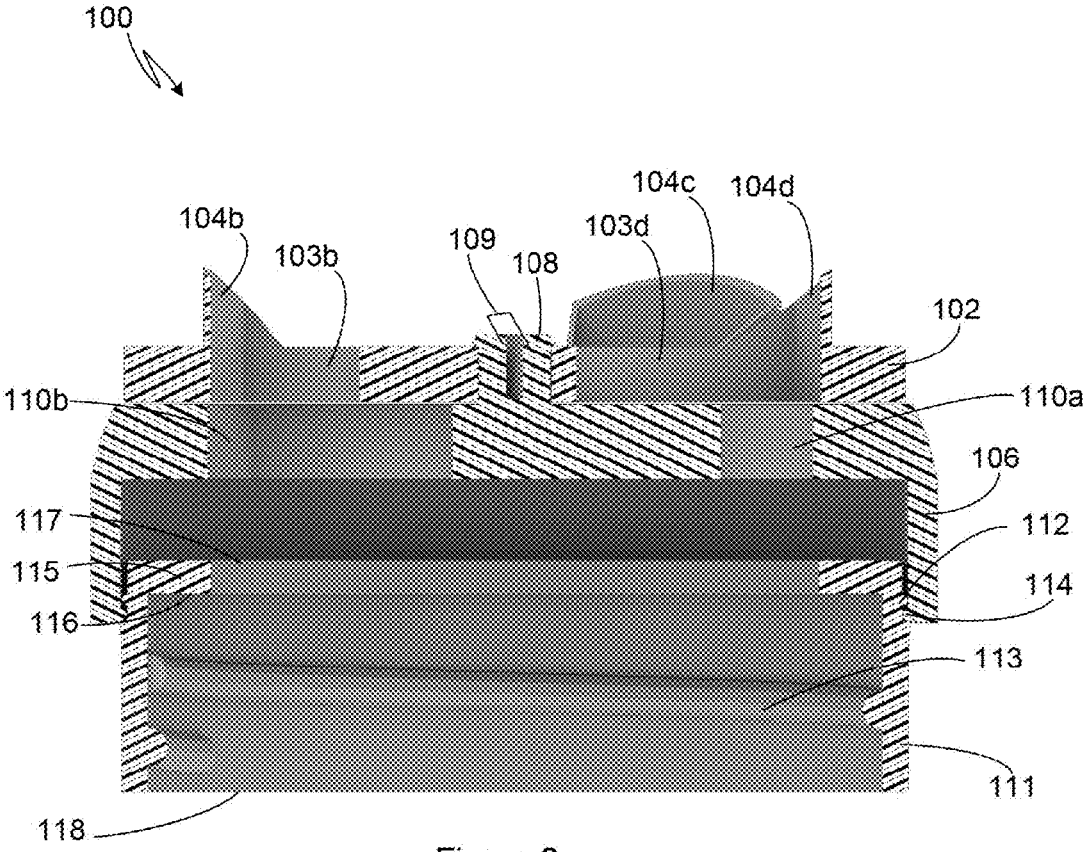
FIG. 3 is a sectional view of the adjustable dispensing cap of FIGS. 1 and 2 taken along the line III-III of FIG. 1.
Figure 4:
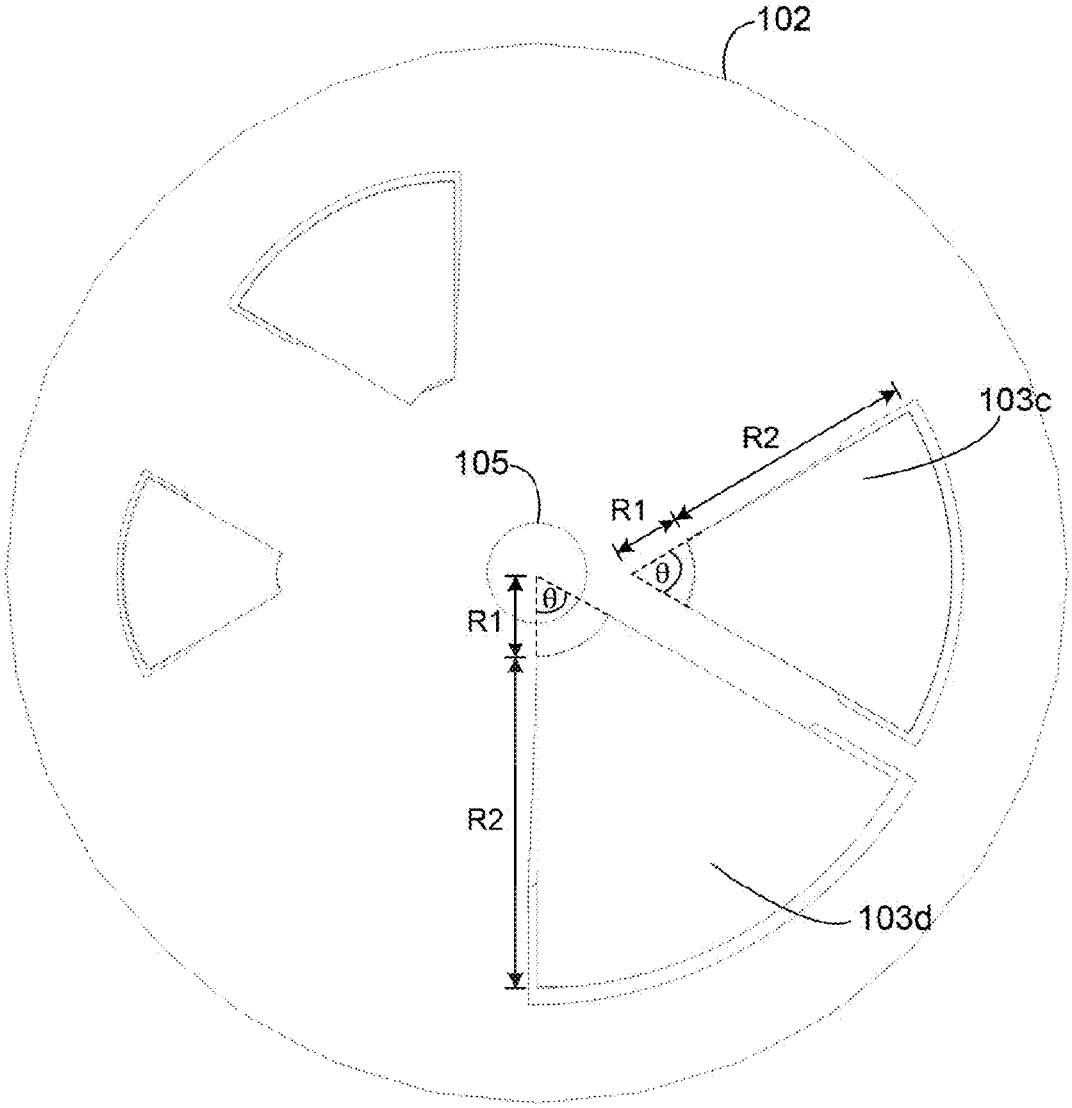
FIG. 4 is a schematic plan view of a component of the adjustable dispensing cap of FIGS. 1 through 3.

FIGS. 1 and 2 show a perspective view and exploded perspective view, respectively, of an adjustable dispensing cap 100 in accordance with an exemplary embodiment of the present invention. FIG. 3 shows a sectional view of the adjustable dispensing cap 100 taken along the line III-III of FIG. 1. FIG. 4 shows a schematic plan view of a first member 102 of the adjustable dispensing cap 100.

The adjustable dispensing cap 100 comprises a first member 102, which includes four through holes 103*a* through 103*d* that are aligned into two pairs along diametrical axes (represented by dotted lines) that pass through a central through hole 105 and post 108: 1) a pair of through holes 103*a*, 103*c*; and 2) a pair of through holes 103*b*, 103*d*. Each of the through holes 103*a* through 103*d* includes a respective spout 104*a* through 104*d* adjacent thereto. In this configuration, one through hole of each pair (e.g., through hole 103*b* of the pair of through holes 103*b*, 103*d*) serves as the pour hole for dispensing liquid with the respective spout (e.g., spout 104*b*) helping to direct the flow of liquid and prevent drips during and after a pour, while the other through hole of the pair (e.g., through hole 103*d* of the pair of through holes 103*b*, 103*d*) serves as a vent hole that enhances flow of the liquid, particularly when using rigid containers (i.e., as liquid exits the pour hole, air is drawn into the container through the vent hole to avoid creating a partial vacuum within the container and inhibiting flow of the liquid). As discussed in greater detail below, the through holes of each pair can perform either role (i.e., pour hole or vent hole) depending on which through hole the user decides to use as the pour hole.

Through holes 103*a* through 103*d* each have a different size in order to accommodate different liquids of varying viscosities, to accommodate liquids whose viscosity changes as a result of factors such as temperature, age, and agitation, and/or to otherwise provide a user with the ability to select multiple different flow rates (i.e., pour speeds). In this embodiment, through hole 103*d* has the largest size and is intended for use with liquids having a greater viscosity or where an increased flow rate is otherwise desired, while through hole 103*a* has the smallest size and is intended for liquids having a lesser viscosity or where a decreased flow rate is otherwise desired. Preferably, the through holes of the first member 102 increase or decrease in size (e.g., in width, diameter, area, etc.) in a fixed proportion between the largest and smallest through holes. Preferably, the fixed proportion falls within the range of 2:5 to 4:5 and, more preferably, the fixed proportion is 3:5. For example, for a fixed proportion of 3:5, through hole 103*c* would be ⅗ the size of through hole 103*d*, through hole 103*b* would be ⅗ the size of through hole 103*c*, and through hole 103*a* would be ⅗ the size of through hole 103*b*. The inventor has found that using a fixed proportion for the through hole sizes enables users to conveniently and predictably select a pour hole that they determine to be comfortable for pouring, and later consistently return to that position. The inventor has also found that the specific fixed proportions discussed above are particularly desirable because they enable a user to dispense common liquids (e.g., maple syrup) in acceptable and consistent timeframes (e.g., 3-5 seconds), after which the user might otherwise become uncomfortable or irritated for lack of strength and/or patience.

In this embodiment, through holes 103*a* through 103*d* and through hole 110*b* (discussed below) have a rounded wedge shape. With reference to FIG. 4, the size of each through hole can be calculated as the area by the following formula:

$$\text{Area} = \left(\frac{\theta}{360}\right)(\pi(R1 + R2)^2 - \pi R1^2) \qquad \text{Formula 1}$$

where θ is an arc angle, and R1 and R2 are radii as shown in FIG. 4. The wedge shape provides an advantage over circular through holes (e.g., adjustable dispensing cap 400 of FIGS. 8 and 9) by increasing the area of the through holes and the number of through holes that can fit within a given region of a circular first member such as first member 102. Accordingly, this embodiment, through holes 103*a* through 103*d* decrease in area, as calculated above, in a fixed proportion of 3:5: the area of through hole 103*c* is ⅗ that of through hole 103*d*; the area of through hole 103*b* is ⅗ that of through hole 103*c*; and the area of through hole 103*a* is ⅗ that of through hole 103*b*.

The first member 102 is rotatively coupled to a second member 106. In this exemplary embodiment, the second member 106 comprises a sealing surface 107, a post 108 having two flexible tabs 109, a pair through holes 110*a*, 110*b* that are aligned along a diametrical axis passing through the post 108, and a lip 114. The post 108 is inserted into the center through hole 105 of first member 102, upon which the two flexible tabs 109 depress toward each other and then re-expand to secure the first member 102 to the second member 106 while still allowing the first member 102 and the second member 106 to rotate relative to each other and the remainder of the adjustable dispensing cap 100 about a longitudinal axis that passes through the first member 102 and the second member 106, as shown. In this embodiment, the diametrical axes of the first member 102 and the second member 106 are perpendicular to the longitudinal axis. Through hole 110*b* serves as the pour hole through which liquid flows, while through hole 110*a* serves as the vent hole.

The third member 111 comprises a lip 112, threads 113, and an inwardly protruding portion 115 having an underside surface 116. The third member 111 includes an upper opening 117 and a lower opening 118, between which the threads 113 are disposed. The threads 113 are adapted to engage threads of a desired container (e.g., a maple syrup bottle). Accordingly, the shape and size of the third member 111 depends on the container to which it is to be attached. In this embodiment, the second member 106 is rotatively coupled to the third member 111 in a snap-on fashion, where the lip 114 disposed around the inner circumference of the second member 106 engages the lip 112 of the third member 111 (see FIG. 3). In this manner, the second member 106 can be rotated relative to both the first member 102 and the third member 111, while preventing leakage of liquid from the adjustable dispensing cap 100. This design also enables the user to easily disassemble the adjustable dispensing cap 100 for cleaning.

In this embodiment, the inwardly protruding portion 115 defines the upper opening 117, where the upper opening has a diameter that is less than the diameter of the lower opening 118. When the third member 111 is secured to a container, as discussed below, the underside surface 116 of the inwardly protruding portion 115 abuts the top of the opening of the container (e.g., the top of the opening in the neck of a bottle), thereby making a seal that prevents liquid that is exiting the container from leaking down the threads 113 of the third member 111 and onto the exterior of the container.

In operation, a user screws the third member 111 onto a container such that the threads 113 engage threads on the container and the underside surface 116 of the inwardly protruding portion 115 creates a seal with the top of the opening of the container. The user can then easily rotate (e.g., with between 0.05 to 0.5 foot-pounds of force) the first member 102 and/or the second member 106 relative to each other such that either the pair of through holes 103*a*, 103*c* or 103*b*, 103*d* overlaps the pair of through holes 110*a*, 110*b* of the second member 106. Stated differently, the user rotates the first member 102 and/or the second member 106 to select a through hole (i.e., pour hole) having a desired size and overlap the selected through hole, in whole or in part, with the through hole 110*b* of the second member 106. Because the sealing surface 107 contacts the underside surface (not shown) of the first member 102, a flow path for the liquid is thereby defined from the inner volume of the container, through the through hole 110*b* in the second member 106 and the selected through hole in the first member 102, while a flow path for air is defined from the environment, through the other paired through hole in the first member 102 that is diametrically aligned with the selected through hole, through the through hole 110*a* in the second member 106, and into the inner volume of the container. A user can also achieve a closed position by rotating the first member 102 and/or the second member 106 relative to each other such that none of the through holes of the first member 102 overlap any through holes of the second member 106.

Locating the variously sized through holes on the first member 102 (rather than, for example, the second member as in the adjustable dispensing cap 200) increases visibility of the through holes to be selected and therefore can make selection of a pour hole easier for the user. Further, because both the first member 102 and the second member 106 rotate relative to each other and the third member 111, a user can orient the selected pour hole in any direction relative to the container to facilitate easy pouring. For example, if the container has a handle of a left side of the container, the user may wish to orient the selected pour hole to the right side of the container by rotating the first member 102 and the second member 106 in unison relative to the third member 111 and the container. In another example, a user may wish to orient the selected pour hole to the front or rear of a container so that the user can use two hands to grip the container on the left and right sides and tilt the container toward or away from his or her body.

Figure 5:
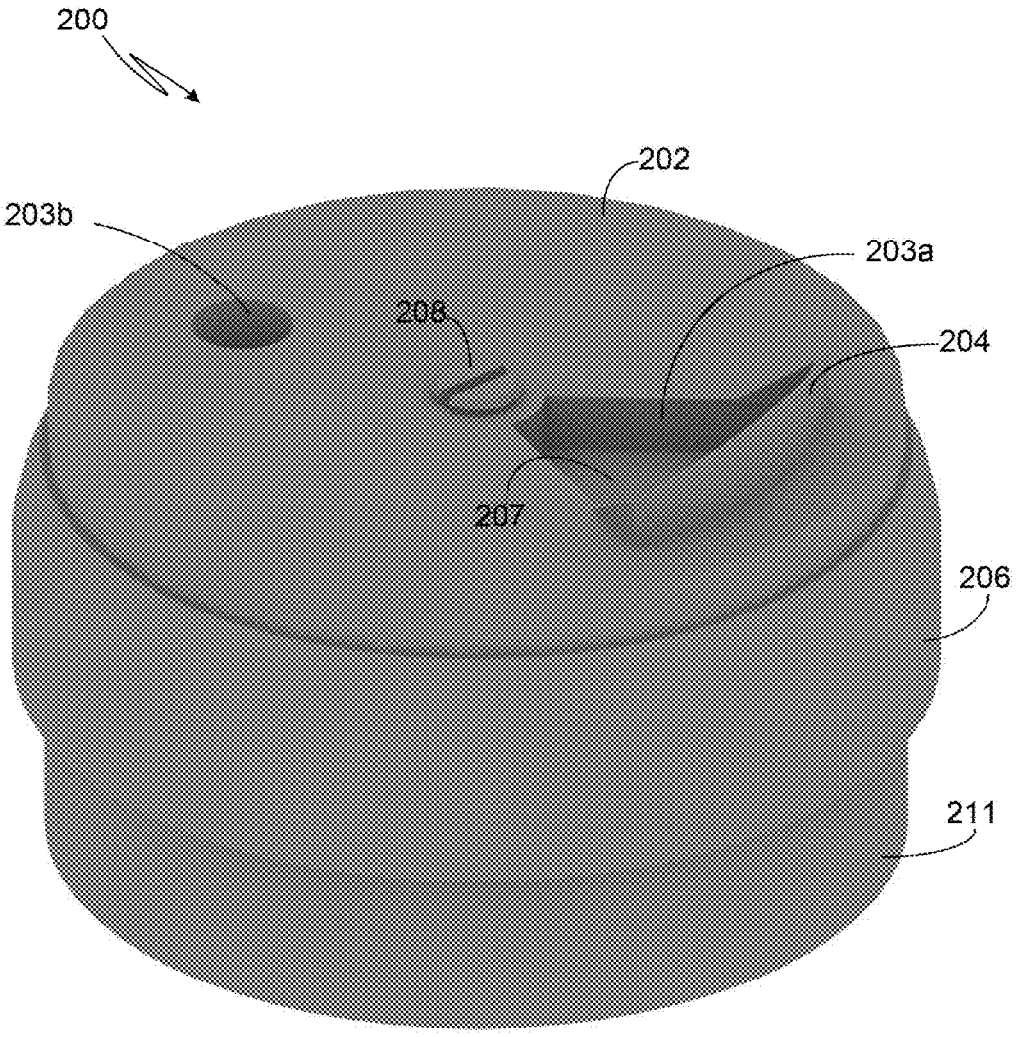
FIG. 5 is a perspective view of an assembled adjustable dispensing cap in accordance with a second embodiment of the present invention.
Figure 6:
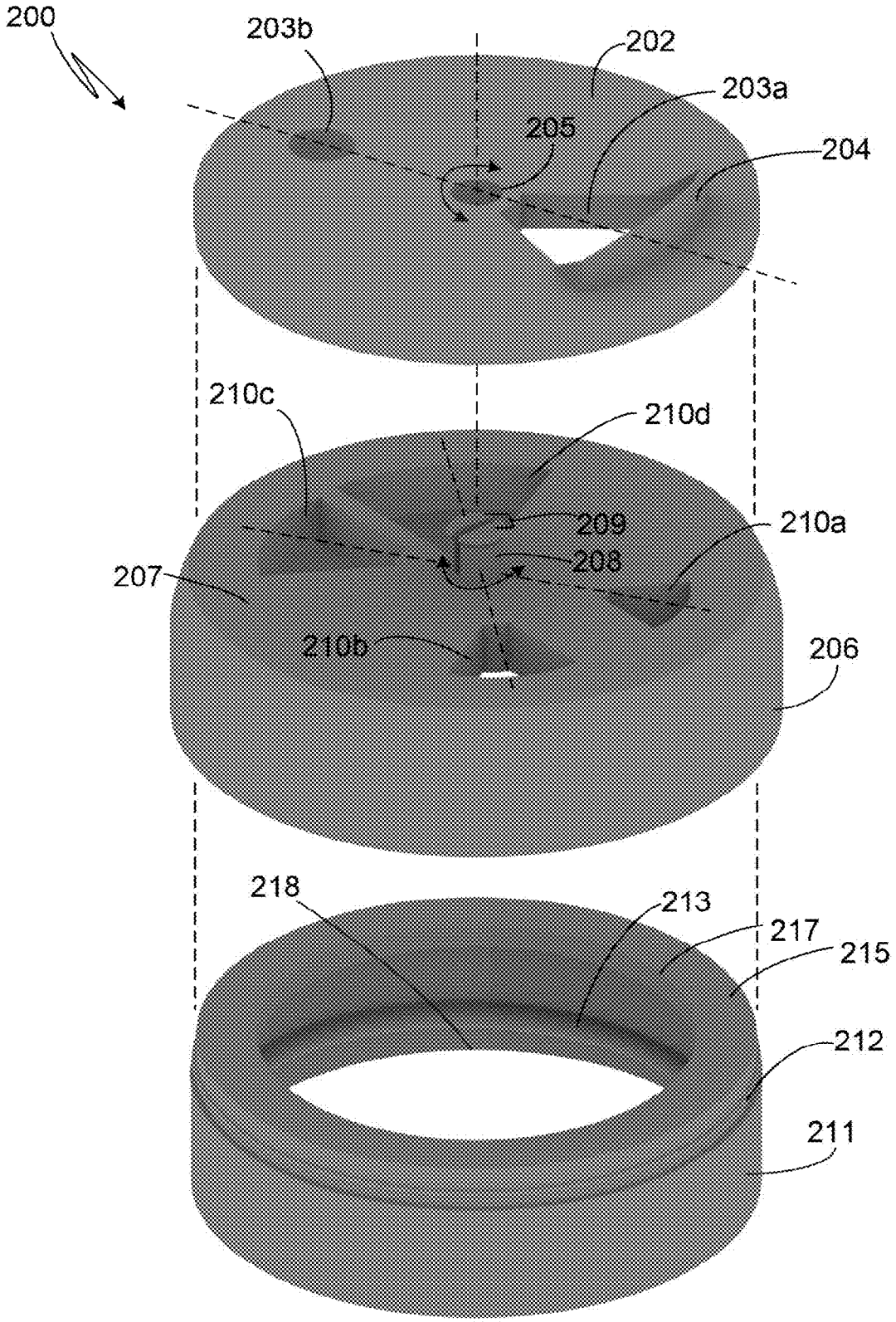
FIG. 6 is an exploded perspective view of the adjustable dispensing cap of FIG. 5.

FIGS. 5 and 6 show a perspective view and exploded perspective view, respectively, of an adjustable dispensing cap 200 in accordance with an exemplary embodiment of the present invention. Like the adjustable dispensing cap 100, the adjustable dispensing cap 200 comprises a first member 202, a second member 206, and a third member 211. In this embodiment, however, the first member 202 includes a pair of through holes 203*a*, 203*b* diametrically aligned through a center through hole 205, and a spout 204 adjacent through hole 203*a*. In this configuration, through hole 203*a* serves as the pour hole for dispensing liquid with the spout 204 helping control the direction of the flow, while through hole 203*b* serves as the vent hole.

In this embodiment, the second member 206, rather than the first member 202, includes four through holes 210*a* through 210*d* that are aligned into two pairs along diametrical axes that pass through the post 208: 1) a pair of through holes 210*a*, 210*c*; and 2) a pair of through holes 210*b*, 210*d*. Through holes 210*a* through 210*d* each have a different size: through hole 210*d* is largest, followed by, in descending order, through holes 210*c*, 210*b*, and 210*a*.

In operation, a user screws the third member 211 onto a container such that the threads 213 engage threads on the container. The user then rotates the first member 202 and/or the second member 206 such that the pair of through holes 203*a*, 203*b* overlap (i.e., partially or completely align with) either the pair of through holes 210*a*, 210*c*, or the pair of through holes 210*b*, 210*d*. Stated differently, the user rotates the first member 202 and/or the second member 206 such that the through hole 203*a* (i.e., the pour hole) overlaps, in whole or in part, a selected through hole in the second member 206 having a desired size that corresponds to the desired flow rate for the liquid to be dispensed. A flow path for the liquid is thereby defined from the inner volume of the container, through the selected through hole in the second member 206 and the through hole 203*a* in the first member 202, while a flow path for air is defined from the environment, through the other paired through hole in the second member 206 that is diametrically aligned with the selected through hole, through the through hole 203*b* in the first member 202 and into the inner volume of the container. A user can also achieve a closed position by rotating the first member 202 relative to the second member 206 such that the pair of through holes 203*a*, 203*b* does not overlap either pair of through holes in the second member 206.

Figure 7:
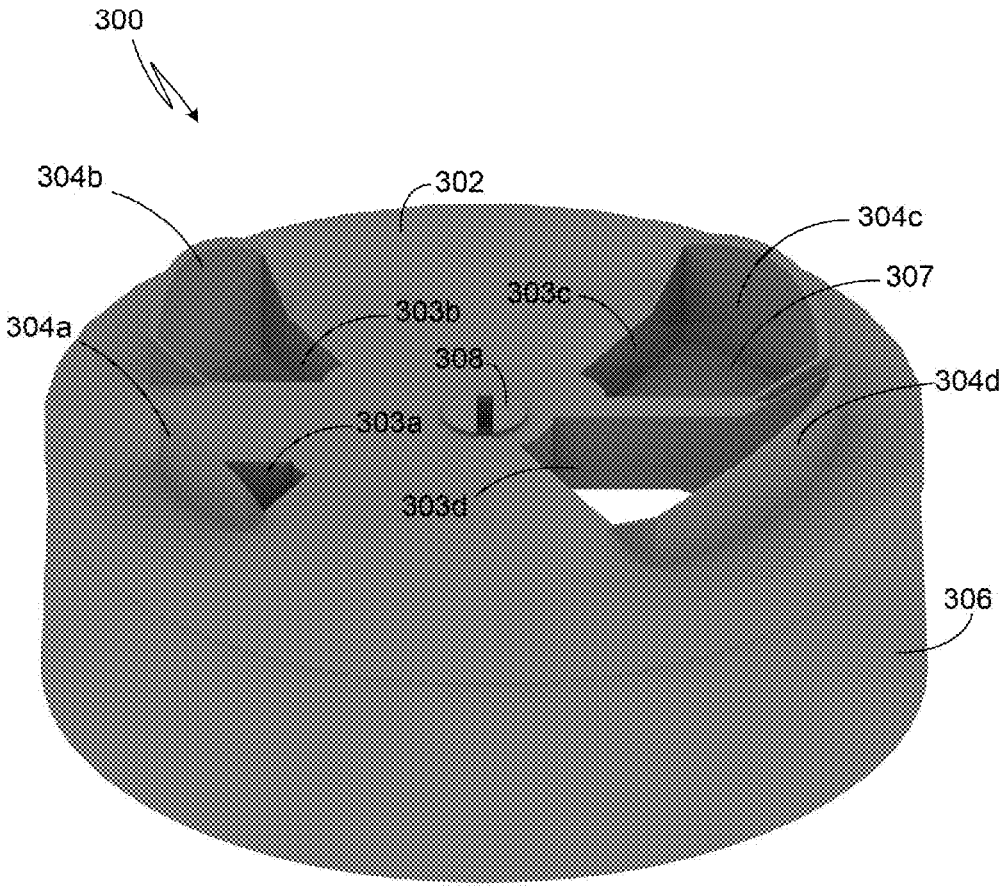
FIG. 7 is a perspective view of an assembled adjustable dispensing cap in accordance with a third embodiment of the present invention.
Figure 8:
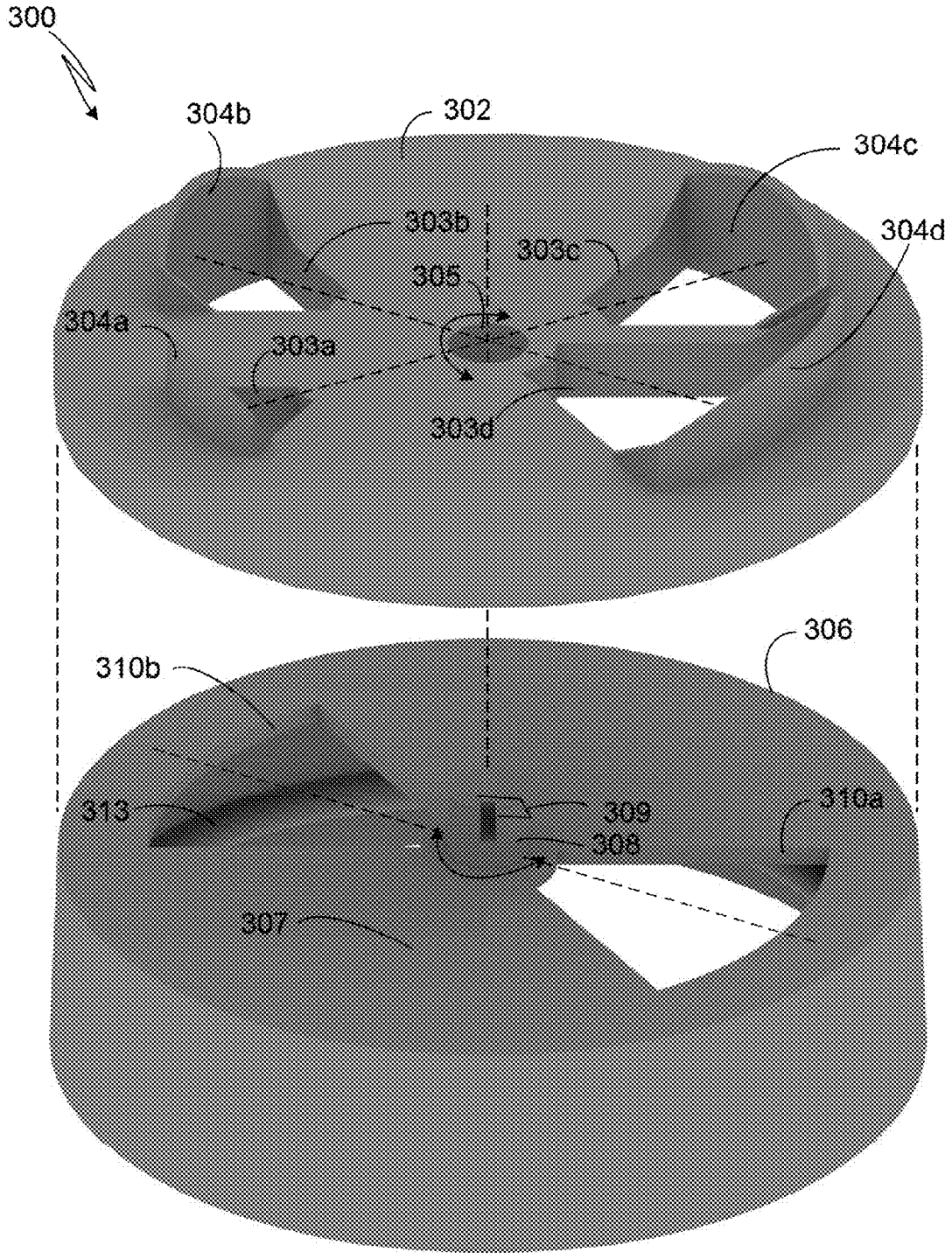
FIG. 8 is an exploded perspective view of the adjustable dispensing cap of FIG. 7.

FIGS. 7 and 8 show a perspective view and exploded perspective view, respectively, of an adjustable dispensing cap 300 in accordance with an exemplary embodiment of the present invention. Like the adjustable dispensing cap 100 of FIGS. 1 through 4, the adjustable dispensing cap 300 comprises a first member 302 and a second member 306, where the first member 302 comprises four differently sized through holes 303*a* through 303*d* that are aligned into two pairs along diametrical axes that pass through a central through hole 305: 1) a pair of through holes 303*a*, 303*c*; and 2) a pair of through holes 303*b*, 303*d*. Similarly, one through hole of each pair serves as a pour hole while the other through hole of the pair serves as a vent hole, and each of the through holes 303*a* through 303*d* includes a respective spout 304*a* through 304*d* adjacent thereto. However, the adjustable dispensing cap 300 does not include a third member (e.g., such as third members 111 and 211); the second member 306 also functions as the third member and includes threads 313 for engaging with threads on a container.

The through holes 303*a* through 303*d* of the first member 302 each have a different size that is intended to accommodate liquid of varying viscosities and/or to otherwise increase or decrease the flow rate of the liquid being dispensed: through hole 303*d* is largest, followed by, in descending order, through holes 303*c*, 303*b*, and 303*a*. The second member 306 includes a single pair through holes 310*a*, 310*b* that are aligned along a diametrical axis passing through the post 308 as shown. In this embodiment, through holes 310*a* and 310*b* are the same size and shape to enable pouring in two directions with respect to the container to which the adjustable dispensing cap 300 is attached (e.g., left and right pouring)

In operation, a user selects one of the through holes 303*a* through 303*d* having a desired size and rotates the first member 302 relative to the second member 306 such that the selected through hole overlaps through hole 310*a* or through hole 310*b*. As previously discussed, a flow path for liquid is thereby defined through the selected through hole in the first member 302 and the overlapped through hole in the second member 306, while a flow path for air is defined through the other paired through hole in the first member 302 (i.e., the through hole that is aligned with the selected through hole) and the other through hole in the second member 306.

Figure 9:
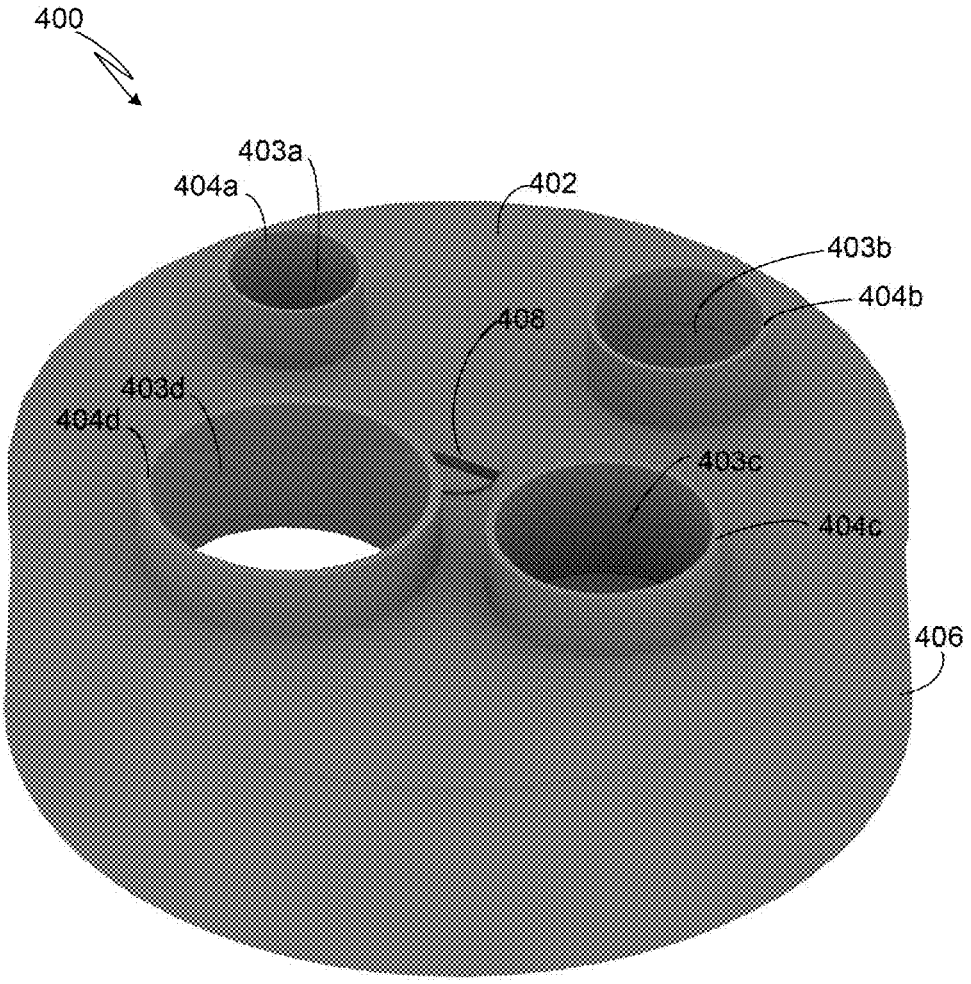
FIG. 9 is a perspective view of an assembled adjustable dispensing cap in accordance with a fourth embodiment of the present invention.
Figure 10:
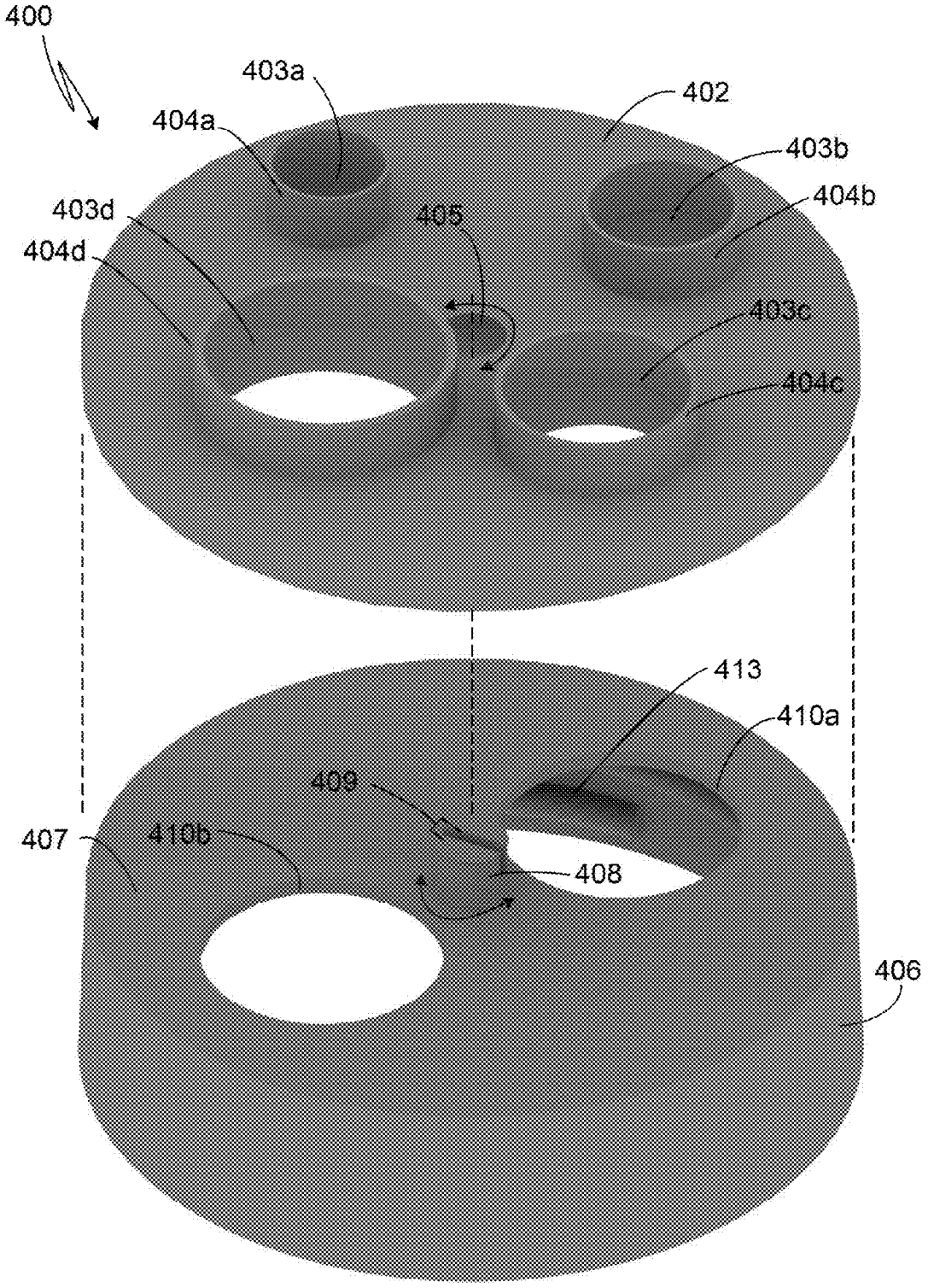
FIG. 10 is an exploded perspective view of the adjustable dispensing cap of FIG. 9.

FIGS. 9 and 10 show a perspective view and exploded perspective view, respectively, of an adjustable dispensing cap 400 in accordance with an exemplary embodiment of the present invention. Like the adjustable dispensing cap 300 of FIGS. 7 and 8, adjustable dispensing cap 400 does not include a third member because the second member 406 also functions as the third member and includes threads 413 for engaging with threads on a container. Similarly, the first member 402, rather than the second member 406, includes through holes 403*a* through 403*d* having different sizes to accommodate liquids of varying viscosities and/or otherwise achieve different flow rates. Lastly, unlike the adjustable dispensing caps 100, 200, and 300, the adjustable dispensing cap 400 includes through holes and spouts that are circular in shape, where the circular spouts extend around the entire circumference of the circular through holes as shown. The area for each circular through hole can be calculated with the following formula:

$$\text{Area}=\pi r^2 \qquad \text{Formula 2}$$

where r is the radius of each circular through hole.

Figure 11:
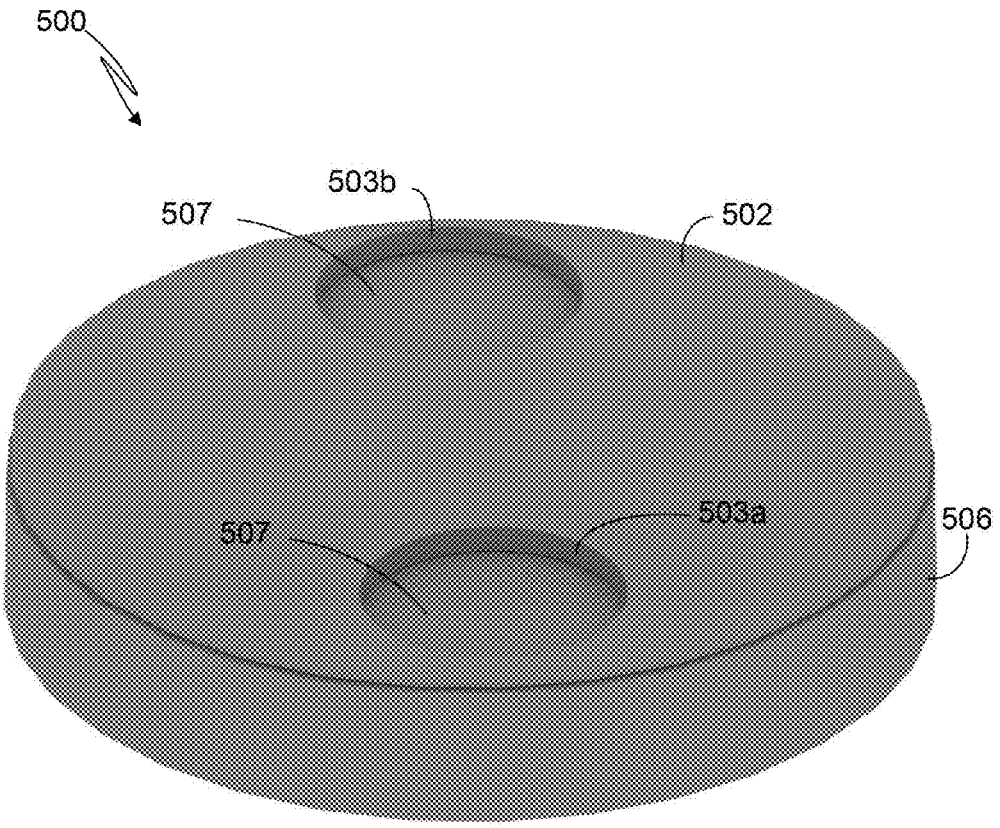
FIG. 11 is a perspective view of an assembled adjustable dispensing cap in accordance with a fifth embodiment of the present invention
Figure 12:
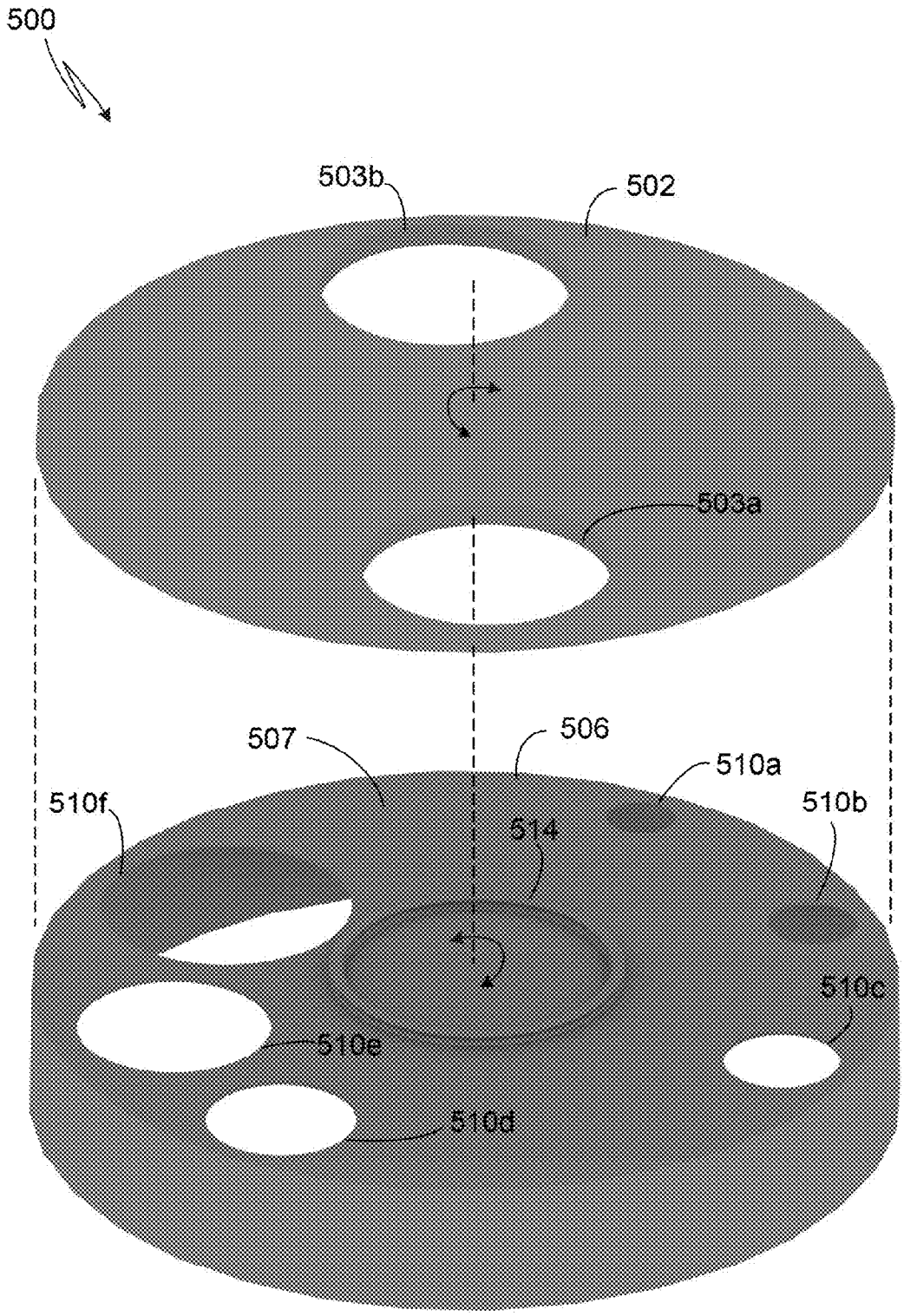
FIG. 12 is an exploded perspective view of the adjustable dispensing cap of FIG. 11.

FIGS. 11 and 12 show a perspective view and exploded perspective view, respectively, of an adjustable dispensing cap 500 in accordance with an exemplary embodiment of the present invention. Like the adjustable dispensing caps 300 and 400, the adjustable dispensing cap 500 does not include a separate third member because the second member 506 also functions as the third member. Here, the second member 506 is attached to a container via a pressure fit (e.g., the second member 506 slides onto the neck of a bottle) rather than via threads. However, this and other embodiments can use any suitable connection means, including, but not limited to, threads, pressure fitting, clips and brackets In this exemplary embodiment, the through holes 503*a* and 503*b* of the first member are circular in shape but do not include a raised spout portion. Also, the second member 506 includes six differently sized circular through holes 510*a* through 510*f* to accommodate liquid of varying viscosities. For example, in this embodiment, through hole 510*f* has the largest area, followed by, in descending order, through holes 510*e*, 510*d*, 510*c*, 510*b*, and 510*a*. FIG. 11 further shows the adjustable dispensing cap 500 in a closed position (i.e., when not dispensing liquid) where the through holes 503*a* and 503*b* are not overlapped with any of the through holes 510*a* through 510*e*, but are instead blocked by sealing surface 507.

Unlike the embodiments of FIGS. 1 through 10, the first member 502 is not coupled to the second member 506 via a post with tabs. Instead, the first member 502 is rotatively coupled to the second member 506 via a circular rim on the underside of the first member 502 (not shown) that snaps onto and engages a raised circular lip 514 on the second member 506. In general, however, any suitable coupling mechanism can be used that enables the first member to rotate relative to the second member in this and other embodiments.

In the embodiments of FIGS. 1 through 12, the through holes and spouts have wedge-shaped or circular designs. In other embodiments of the present invention, the through holes and spouts can having varying sizes and shapes apart from those depicted in the drawings in order to achieve desired flow characteristics for liquids. Similarly, a greater number of through holes can be incorporated into the first members and/or the second members so as to accommodate a greater number of different viscosities and/or a greater number of selectable flow rates. The first members and/or second members can also have various different shapes and sizes apart from the circular shapes depicted in the drawings. In addition, the adjustable dispensing caps and components thereof can be made from plastics, metals, composites, or any other suitable material known in the art and combinations thereof.

Accordingly, embodiments of the present invention provide dispensing caps that enable a user to dispense liquids of varying viscosities without having to replace the caps, squeeze the container, or otherwise expend energy to compensate for the varying viscosities and/or desired flow rates. In each embodiment, the user, regardless of age or strength, can quickly and easily rotate a first member and/or second member to select a particular pour hole to provide a desired flow rate for a particular liquid. Rather than provide for infinitely variable hole sizes and resulting flow rates, embodiments of the present invention provide discrete hole shapes and sizes that enable the user to predictably and consistently achieve a particular flow rate. If the user wishes to later alter the flow rate of the liquid, or if the user later uses the dispensing cap for another liquid having a different viscosity, the user can simply rotate the first member and/or second member again to select a different pour hole. Further, the relatively simple construction of dispensing caps in accordance with embodiments of the present invention provides for easy disassembly and cleaning. Lastly, while embodiments of the present invention have been discussed herein with respect to liquids, embodiments of the present invention can also be used with other substances capable of flowing through the pour holes, including granular solids (e.g., sugar) and mixtures of liquids and undissolved solids.

EXAMPLES

The following are examples in which adjustable dispensing caps were created and operated in accordance with embodiments of the present invention to demonstrate the effects of pour hole size on liquids of varying viscosities, and also to demonstrate the correlation between pour hole sizes in a fixed proportion and flow rates in a similar fixed proportion.

Example 1

In this example, the adjustable dispensing cap 100 of FIGS. 1 through 4 was created, where the pour holes possessed the following design dimensions:

TABLE 1

| Pour hole | Θ (degrees) | R2 (in) | R1 (in) | Area ($in^2$) |
|---|---|---|---|---|
| 1 (e.g., through hole 103d) | 60 | 0.490 | 0.124 | 0.189 |
| 2 (e.g., through hole 103c) | 60 | 0.382 | 0.097 | 0.115 |
| 3 (e.g., through hole 103b) | 60 | 0.286 | 0.075 | 0.065 |
| 4 (e.g., through hole 103a) | 60 | 0.228 | 0.058 | 0.041 |

As shown, the through holes of the dispensing cap were designed to have decreasing areas in a fixed proportion of 3:5. The dispensing cap was prepared via 3-Dimensional printing and therefore the actual dimensions of the dispensing cap produced and tested differed slightly from the design dimensions. The measured dimensions (+/−0.002 in) of the tested cap were as follows:

TABLE 2

| Pour hole | Θ (degrees) | R2 (in) | R1 (in) | Area ($in^2$) |
|---|---|---|---|---|
| 1 (e.g., through hole 103d) | 60 | 0.500 | 0.108 | 0.187 |
| 2 (e.g., through hole 103c) | 60 | 0.376 | 0.091 | 0.110 |
| 3 (e.g., through hole 103b) | 60 | 0.301 | 0.080 | 0.073 |
| 4 (e.g., through hole 103a) | 60 | 0.226 | 0.066 | 0.042 |

The dispensing cap was tested as follows:

TABLE 3

| | |
|---|---|
| Test liquid: | Log Cabin Original Syrup<br>Pinnacle Foods Group LLC<br>Cherry Hill NJ 08003-3620<br>UPC: 43000 00037<br>Best By: May 8, 2014<br>0148 49 S3 31<br>Ingredients: corn syrup, liquid sugar (natural sugar, water), water, salt, natural and artificial flavor (lactic acid), sodium hexametaphosphate, preservatives (sodium benzoate, sorbic acid), caramel color, phosphoric acid |
| Properties of test liquid: | Log Cabin Original Syrup is a mixture of several component liquids and a small amount of dissolved solids. The main component liquid is corn syrup, which has temperature-dependent viscosity and is known to exhibit the non-Newtonian property of viscosity change with sheer rate history. Both variations were shown to be true experimentally for this liquid (see testing protocol). |
| Testing Protocol: | Previous experimental data indicated that three pours before making measurements was adequate to create repeatable results and mitigate the effects of temperature and sheer rate history on viscosity. Pre-conditioning (three pours) began with the syrup at a temperature of approximately 37 F.<br>Because the syrup warms over the time needed to perform testing (affecting the viscosity), the hole size was varied in a strict rotation, rather than with using back-to-back runs with a single hole size. For each numbered pour listed below, the syrup was poured through the noted holes, in sequential order, into a 100 mL graduated cylinder.<br>The viscosity variation was experimentally indicated in the test liquid by measuring the constant vertical speed of a 0.500 inch diameter steel ball falling through the liquid (i.e., in a full 100 mL graduated cylinder). The usefulness of this measurement to indicate viscosity is well-known and is not discussed herein. The range for the test conditions was chosen to correspond to typical conditions for real-life use: in this case, fluid starting at 40 degrees Fahrenheit (refrigerated) and gradually warming to 59 degrees Fahrenheit and agitated by pouring (59 degrees F was used as the high temperature condition because a container of refrigerated syrup left at room temperature for 15 minutes reached this temperature). The test conditions and results were as follows: |

| Condition | Measured constant vertical speed |
|---|---|
| Unstirred liquid, 40 F. | 3.1 cm/s |
| Agitated liquid, 40 F. | 5.6 cm/s |
| Unstirred liquid, 59 F. | 7.1 cm/s |
| Agitated liquid, 59 F. | 10.1 cm/s |

Instead of computing an average flow rate for a given hole, the ratio of calculated flow rate to the next hole was used and demonstrates control.

To make the time measurements, a digital stopwatch with .01 second resolution was started and stopped by hand when the liquid level was observed to pass the indicated points (20 mL and 90 mL) on the graduated cylinder. The observational measurement error is estimated to be approximately 0.1-0.2 seconds.

A flat surface was set at a fixed 20 degree angle from horizontal to hold the container (a 32 oz maple syrup bottle) at a repeatable angle. The vertical wall of the container rested against the flat surface for the entire measured pour.

When the liquid was returned to the container to prepare for the next pour, some liquid (e.g., less than 10 mL) remained on the interior surface of the graduated cylinder. Because of this, and the fact the pour would start before the container fully arrived at the fixed repeatable angle, the start time mark was chosen to be the 20 mL mark and the end point was the 100 mL mark. However, not all of the residual liquid would return to the bottom before the next pour started, which represented a source of measurement error.

| | | Time to pour 70 ml of liquid (seconds) | | |
|---|---|---|---|---|
| Results | Pour hole No. | Pour #1 | Pour #2 | Pour #3 |
| | Pour hole 1 | 12.01 | 8.51 | 6.39 |
| | Pour hole 2 | 18.96 | 14.89 | 10.96 |
| | Pour hole 3 | 36.01 | 33.26 | 25.89 |
| | Pour hole 4 | 86.14 | 61.45 | 59.7 |

TABLE 3-continued

| Pour hole No. | Flow rate (70 mL/time to pour) (mL/s) | | |
|---|---|---|---|
| | Pour #1 | Pour #2 | Pour #3 |
| Pour hole 1 | 5.83 | 8.23 | 10.95 |
| Pour hole 2 | 3.69 | 4.7 | 6.39 |
| Pour hole 3 | 1.94 | 2.1 | 2.7 |
| Pour hole 4 | 0.81 | 1.14 | 1.17 |
| | Ratios of flow rates to next smallest hole | | |
| | Pour #1 | Pour #2 | Pour #3 |
| Pour holes 1:2 | 0.63 | 0.57 | 0.58 |
| Pour holes 2:3 | 0.53 | 0.45 | 0.42 |
| Pour holes 3:4 | 0.42 | 0.54 | 0.43 |

Figure 13A:
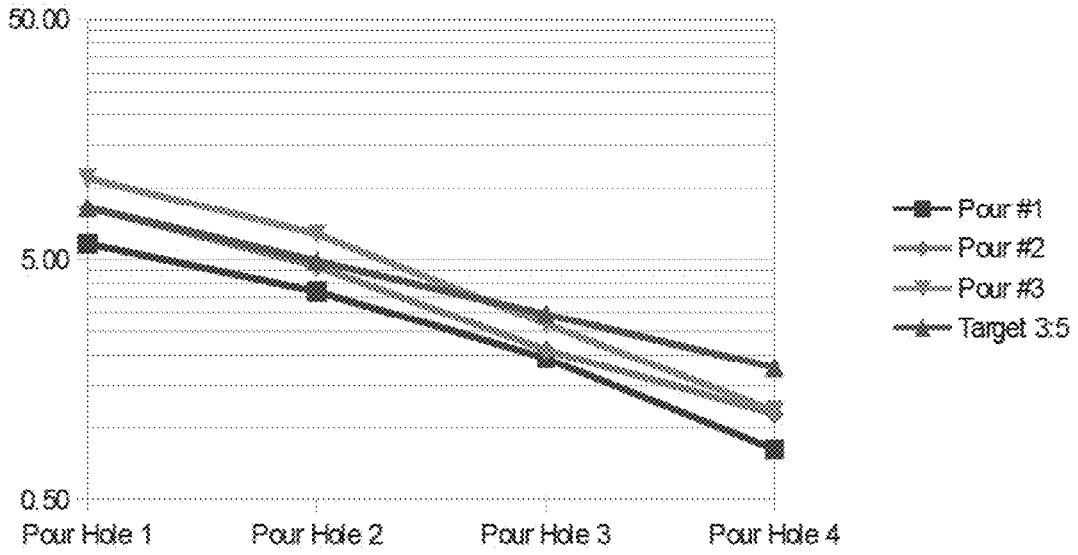
FIGS. 13A and 13B are graphs showing experimental flow rate data obtained in accordance with embodiments of the present invention.

FIG. 13A is a graph showing the flow rate results for each pour hole and pour in Tables 1 and 2. For comparison purposes, a fourth series, "Target 3:5", was plotted starting at the flow rate for Pour hole 1 at Pour #2 and was then reduced by 3:5 for each successive hole. Note that the y-axis scale is logarithmic in this graph.

The data shown in Tables 1 and 2 and FIG. 13A demonstrates that the ratios of flow rates between pour holes are consistent and are proportionate to the ratios between the pour hole sizes, even where the viscosity of the liquid changes dramatically (i.e., as shown by the constant vertical speed measurements). The data also demonstrates that this embodiment provides an effective way to limit the flow rate of a liquid to a target range (e.g., 3.5 mL/s to 6.5 mL/s) even as the viscosity changes.

Example 2

In this example, the same adjustable dispensing cap of Example 1 was used to test a second liquid, water, which has a substantially different viscosity than the maple syrup of Example 1. The dispensing cap was tested as follows:

TABLE 4

| | | | | |
|---|---|---|---|---|
| Test liquid: | Potable water | | | |
| Properties of test liquid: | Temperature of approximately 60 degrees Fahrenheit. | | | |
| Testing Protocol: | Approximately 1000 mL of water was placed in a 32 oz maple syrup bottle, and the first 900 to 1000 mL was poured into a second container with 100 mL graduated lines. Each pour was timed to determine an average flow rate for each hole size compared to the next smaller hole, as well as the variation in flow rate as the bottle emptied.<br>To make the time measurements, a video recording at 29.97 frames per second was used to determine the video frame number when the liquid level was observed to pass indicated points (100 mL, 200 mL, 300 mL, 400 mL, 500 mL, 600 mL, 700 mL, 800 mL, and 900 mL) on the second container. The graduated markings on the second container were calibrated using a 100 mL graduated cylinder of good quality. The error in marking plus observational measurement error is estimated to be approximately 10-30 mL.<br>The 32 oz maple syrup bottle containing the water was placed on a flat surface and set at a fixed 45 degree angle from horizontal. The vertical wall of the container rested against this flat surface for the entire measured pour. Because the setup requires starting the pour by inverting an upright bottle into this position, the time when the liquid had already reached 100 mL was used as the starting time for measurement.<br>The liquid was returned to the 32 oz syrup container after each pour, and the container with liquid was measured to ensure that less that 0.2 oz of liquid was lost.<br>The empty weight of the 32 oz syrup container was 88 grams. | | | |
| | Pour hole 1 | | | |
| Results | Marker | Frame | calc frames | calc mL/s |
| | 100 ml | 5758 | | |
| | 200 ml | 5833 | 75 | 39.95 |
| | 300 ml | 5891 | 58 | 51.66 |
| | 400 ml | 5948 | 57 | 52.56 |
| | 500 ml | 6015 | 67 | 44.72 |
| | 600 ml | 6080 | 65 | 46.09 |
| | 700 ml | 6134 | 54 | 55.48 |
| | 800 ml | 6198 | 64 | 46.81 |
| | 900 ml | 6269 | 71 | 42.2 |
| | Weight check: 1080 g (container + water) | | | Average = 47.43 (STDEV = 5.37) |

TABLE 4-continued

| Pour hole 2 | | | |
|---|---|---|---|
| Marker | Frame | calc frames | calc mils |
| 100 ml | 8117 | | |
| 200 ml | 8235 | 118 | 25.39 |
| 300 ml | 8320 | 85 | 35.25 |
| 400 ml | 8411 | 91 | 32.92 |
| 500 ml | 8498 | 87 | 34.44 |
| 600 ml | 8602 | 104 | 28.81 |
| 700 ml | 8696 | 94 | 31.87 |
| 800 ml | 8798 | 102 | 29.37 |
| 900 ml | 8903 | 105 | 28.53 |
| Weight check: 1080 g (container + water) | | | Average = 30.82 (STDEV = 3.36) |

| Pour hole 3 | | | |
|---|---|---|---|
| Marker | Frame | calc frames | calc mils |
| 100 ml | 11739 | | |
| 200 ml | 11915 | 176 | 17.02 |
| 300 ml | 12044 | 129 | 23.22 |
| 400 ml | 12188 | 144 | 20.81 |
| 500 ml | 12314 | 126 | 23.78 |
| 600 ml | 12460 | 146 | 20.52 |
| 700 ml | 12586 | 126 | 23.78 |
| 800 ml | 12731 | 145 | 20.66 |
| 900 ml | 12865 | 134 | 22.36 |
| Weight check: 1083 g (container + water) | | | Average = 21.52 (STDEV = 2.28) |

| Pour hole 4 | | | |
|---|---|---|---|
| Marker | Frame | calc frames | calc mils |
| 100 ml | 15648 | | |
| 200 ml | 15925 | 277 | 10.82 |
| 300 ml | 16164 | 239 | 12.54 |
| 400 ml | 16413 | 249 | 12.03 |
| 500 ml | 16681 | 268 | 11.18 |
| 600 ml | 16900 | 219 | 13.68 |
| 700 ml | 17095 | 195 | 15.36 |
| 800 ml | 17332 | 237 | 12.64 |
| 900 ml | 17597 | 265 | 11.31 |
| | | | Average = 12.44 (STDEV = 1.50) |

| Ratios of flow rates to next smallest hole | |
|---|---|
| Pour holes 1:2 | 0.65 |
| Pour holes 2:3 | 0.70 |
| Pour holes 3:4 | 0.58 |

Figure 13B:
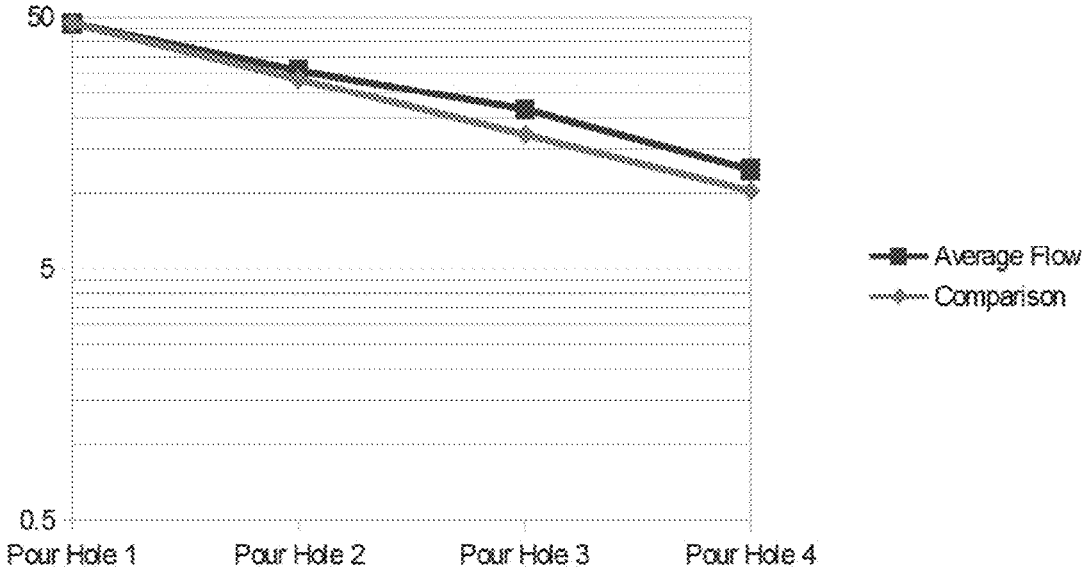

FIG. 13B is a graph showing the average flow rate results for each pour hole from Table 4. For comparison purposes, a "Comparison" series was plotted beginning with the flow rate of Pour hole 1 and decreasing in a 3:5 ratio. Note that the y-axis scale is also logarithmic in this graph.

The data shown in Table 4 and FIG. 13B demonstrate again that the ratios of observed flow rates, which ranged from 0.58 to 0.70, match very closely with ratios of hole areas. Further, as the container emptied, the flow rates did not vary significantly (the standard deviation of calculated flow rate, as a percentage of flow rate, is approximately 12% or less). Accordingly, this data shows that this embodiment also provides a convenient and effective way to limit the flow rate of a liquid to a target range (e.g., 3:5) to control pour speeds with low-viscosity liquids such as water.

While the principles of the invention have been described above in connection with preferred embodiments and examples, it is to be clearly understood that this description is made only by way of example and not as a limitation of the scope of the invention.

The invention claimed is:

1. A dispensing cap for a container, the dispensing cap comprising:

a first member having a plurality of through holes, wherein each through hole of the plurality of through holes of the first member differs in size from other through holes of the first member, wherein each through hole of the plurality of through holes of the first member is aligned along a diametrical axis of the first member with another through hole of the plurality of through holes of the first member, wherein the plurality of through holes of the first member comprises at least two pairs of diametrically aligned through holes, and a second member rotatively coupled to the first member, the second member having a plurality of through holes, wherein each through hole of the plurality of through holes of the second member is aligned along a diametrical axis of the second member with another through hole of the plurality of through holes of the second member, and wherein each through hole of the first member is disposed such that it can overlap, in whole or in part, each through hole of the plurality of through holes of the second member depending on the rotation of one or both of the first member and second member about a longitudinal axis passing through the first member and second member.

2. The dispensing cap of claim 1, wherein the diametrical axes of the first member and the second member are perpendicular to the longitudinal axis.

3. The dispensing cap of claim 1, wherein the plurality of through holes of the first member comprise a spout adjacent thereto.

4. The dispensing cap of claim 1 wherein the first member comprises a central aperture and the second member comprises a central post wherein the central post protrudes upwardly and wherein the central post comprises two flexible tabs and wherein the flexible tabs engage the central aperture of the first member.

5. The dispensing cap of claim 1, wherein the plurality of through holes of the second member comprises two through holes.

6. The dispensing cap of claim 1, wherein the second member further comprises threads operationally configured to engage threads on the container.

7. The dispensing cap of claim 1 wherein the first member further comprises a circular rim aligned along a circumference of the first member and the second member further comprises circular lip aligned along a circumference of the second member, wherein the circular rim of the first member engages the circular lip of the second member.

8. The dispensing cap of claim 1, wherein each through hole of the plurality of through holes of the first member differs in size from other through holes of the plurality of through holes of the first member by a fixed proportion.

9. The dispensing cap of claim 8 wherein the fixed proportion is greater than or equal to 2:5 and less than or equal to 4:5.

10. A dispensing cap coupled to the dispensing cap for a container, the dispensing cap comprising:

a first member having a plurality of through holes, wherein each through hole of the plurality of through holes of the first member is aligned along a diametrical axis of the first member with another through hole of the plurality of through holes of the first member, and a second member rotatively coupled to the first member, the second member having a plurality of through holes, wherein each through hole of the plurality of through holes of the second member is aligned along a diametrical axis of the second member with another through hole of the plurality of through holes of the second member, wherein each through hole of the plurality of through holes of the second member differs in size from other through holes of the second member, wherein the plurality of through holes of the second member comprises at least two pairs of diametrically aligned through holes; and wherein each through hole of the plurality of through holes of the first member is disposed such that it can overlap, in whole or in part, each through hole of the plurality of through holes of the second member depending on the rotation of one or both of the first member and second member about a longitudinal axis passing through the first member and second member.

11. The dispensing cap of claim 10, wherein each through hole of the plurality of through holes of the second member differs in size by a fixed proportion to another through hole of the plurality of through holes of the second member.

12. The dispensing cap of claim 11 wherein the fixed proportion is greater than or equal to 2:5 and less than or equal to 4:5.

13. The dispensing cap of claim 10, further comprising a third member wherein the third member is operationally configured to secure the second member to a container.

14. The dispensing cap of claim 13 wherein the third member comprises a threaded surface operationally configured to engage a threaded container.

15. The dispensing cap of claim 13 wherein the third member comprises a pressure fitting adapted to secure the dispensing cap to the container.

16. The dispensing cap of claim 10 wherein the first member comprises a central aperture and the second member comprises a central post wherein the central post protrudes upwardly and wherein the central post comprises two flexible tabs and wherein the flexible tabs engage the central aperture of the first member.

17. The dispensing cap of claim 10, wherein the second member further comprises threads operationally configured to engage threads on the container.

18. A method for dispensing liquid from a container:

providing a dispensing cap coupled to the container, the dispensing cap comprising:

a first member having a plurality of through holes, wherein each through hole of the plurality of through holes of the first member is aligned along a diametrical axis of the first member with another through hole of the plurality of through holes of the first member; and a second member rotatively coupled to the first member, the second member having a plurality of through holes, wherein each through hole of the plurality of through holes of the second member is aligned along a diametrical axis of the second member with another through hole of the plurality of through holes of the second member; wherein each through hole of the plurality of through holes of the second member differs in size from other through holes of the second member, wherein the plurality of through holes of the second member comprises at least two pairs of diametrically aligned through holes;

rotating one or both of the first member and the second member about a longitudinal axis that passes through the first member and the second member such that each of two through holes of the first member overlap, in whole or in part, a through hole of the second member, thereby defining a first and second flow path from an inner volume of the container through the dispensing cap;

passing liquid from the inner volume of the container through the first flow path;

passing air through the second flow path into the inner volume of the container; and rotating the first member and the second member in unison relative to the container; and passing liquid from the inner volume of the container through the first flow path at a different orientation relative to the container than in the previous passing step.

19. The method of claim 18, further comprising:

selecting a first through hole of the plurality of through holes of the second member based on a first viscosity of liquid to be dispensed from the container; and rotating one or both of the first member and the second member such that a through hole of the first member overlaps, in whole or in part, the selected first through hole of the second member.

20. The method of claim 19, further comprising:

selecting a second through hole of the plurality of through holes of the second member based on a second viscosity of liquid to be dispensed from the container, wherein the second viscosity is greater than the first viscosity and the second selected through hole has a greater area than the first selected through hole; and rotating one or both of the first member and the second member such that a through hole of the first member overlaps, in whole or in part, the selected second through hole of the second member.

* * * * *